US009469953B1

(12) United States Patent
Sherman

(10) Patent No.: US 9,469,953 B1
(45) Date of Patent: Oct. 18, 2016

(54) MECHANICAL SNOW THROWER

(71) Applicant: Jerome Sherman, Cedar Rapids, IA (US)

(72) Inventor: Jerome Sherman, Cedar Rapids, IA (US)

( * ) Notice: Subject to any disclaimer, the term of this patent is extended or adjusted under 35 U.S.C. 154(b) by 69 days.

(21) Appl. No.: 14/643,356

(22) Filed: Mar. 10, 2015

Related U.S. Application Data

(60) Provisional application No. 61/983,544, filed on Apr. 24, 2014.

(51) Int. Cl.
*E01H 5/09* (2006.01)

(52) U.S. Cl.
CPC ..... *E01H 5/098* (2013.01)

(58) Field of Classification Search
CPC ..... E01H 5/02; E01H 5/04; E01H 5/045; E01H 5/08; E01H 5/09; E01H 5/098; B60K 25/08
USPC ..... 37/285, 230; 280/3, 304.2, 7.15, 200, 280/189, 12.1
See application file for complete search history.

(56) References Cited

U.S. PATENT DOCUMENTS 395,548 A * 1/1889 Corbett ..... E01H 5/02 37/285
617,830 A * 1/1899 Herran ..... E01H 5/02 37/285
703,513 A * 7/1902 Hough ..... 56/255
993,739 A 5/1911 Vickebs
2,307,412 A 1/1943 Lewis
2,587,415 A * 2/1952 Vanvick ..... E01H 5/04 180/19.1
2,605,561 A * 8/1952 Maynard ..... E01H 5/04 37/246
2,692,445 A * 10/1954 Darnell ..... E01H 5/04 172/42
2,769,255 A * 11/1956 Mead ..... E01H 5/04 37/257
3,363,345 A * 1/1968 Ober ..... E01H 5/04 37/252
3,947,912 A * 4/1976 Michaels ..... E01H 1/045 15/79.1
4,258,485 A * 3/1981 Gof ..... E01H 5/06 280/253
4,300,295 A * 11/1981 Heismann ..... E01H 5/04 198/676
4,346,526 A * 8/1982 Mattson ..... E01H 5/045 37/259
4,360,983 A * 11/1982 Krug ..... E01H 5/04 366/312
4,455,816 A * 6/1984 Porath ..... A01D 34/475 56/2
4,852,279 A * 8/1989 Gerbrandt ..... E01H 5/045 198/676
4,920,667 A 5/1990 Dixon
5,101,585 A * 4/1992 Gerbrandt ..... E01H 5/04 37/249
D326,457 S 5/1992 Pink
5,410,825 A * 5/1995 Perrelli ..... E01H 5/098 37/232
6,163,986 A 12/2000 Townsend
6,643,958 B1 11/2003 Krejci
6,948,569 B1 9/2005 Conaway
7,810,303 B2 * 10/2010 Goguelet ..... A01D 34/67 56/255

FOREIGN PATENT DOCUMENTS

CA 1196035 10/1985
DE 1131248 B * 6/1962 ..... E01H 5/04

* cited by examiner

*Primary Examiner* — Jamie L McGowan
(74) *Attorney, Agent, or Firm* — Kyle A. Fletcher, Esq.

(57) ABSTRACT

The mechanical snow thrower includes a housing connected to a handle, along with an inlet and outlet. An auger is used to move the snow from the inlet to a fan, which propels the snow through the outlet. A pair of wheels drives the auger, while at least one pair of wheels drives the fan. A gear set connects the wheels to the auger and/or the fan. A clutch may be may use to engage or disengage the wheels from the auger and/or clutch.

10 Claims, 5 Drawing Sheets

MECHANICAL SNOW THROWER

CROSS REFERENCES TO RELATED APPLICATIONS

This non-provisional application claims priority to provisional application 61/983,544 that was filed on Mar. 14, 2014.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to manually powered device for clearing snow and more particularly, to mechanical snow throwers.

During winter, snow removal may be required to provide safe travel surfaces for pedestrians. The manual shovel and motorized snow blower represent opposite extremes. One economical but physically demanding, while the other is expense, but loud and polluting. There is a need for an economical middle ground that is less physically demanding and also free of the noise and pollution.

SUMMARY OF INVENTION

The present invention is a mechanical snow thrower. The snow thrower includes a housing connected to a handle, along with an inlet and outlet. An auger is used to move the snow from the inlet to a fan, which propels the snow through the outlet. A pair of wheels drives the auger, while at least one pair of wheels drives the fan. A gear set connects the wheels to the auger and/or the fan. A clutch may be may use to engage or disengage the wheels from the auger and/or clutch.

These together with additional objects, features and advantages of the mechanical snow thrower will be readily apparent to those of ordinary skill in the art upon reading the following detailed description of the presently preferred, but nonetheless illustrative, embodiments when taken in conjunction with the accompanying drawings.

In this respect, before explaining the current embodiments of the mechanical snow thrower in detail, it is to be understood that the mechanical snow thrower is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the mechanical snow thrower.

It is therefore important that the claims be regarded as including such equivalent construction insofar as they do not depart from the spirit and scope of the mechanical snow thrower. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
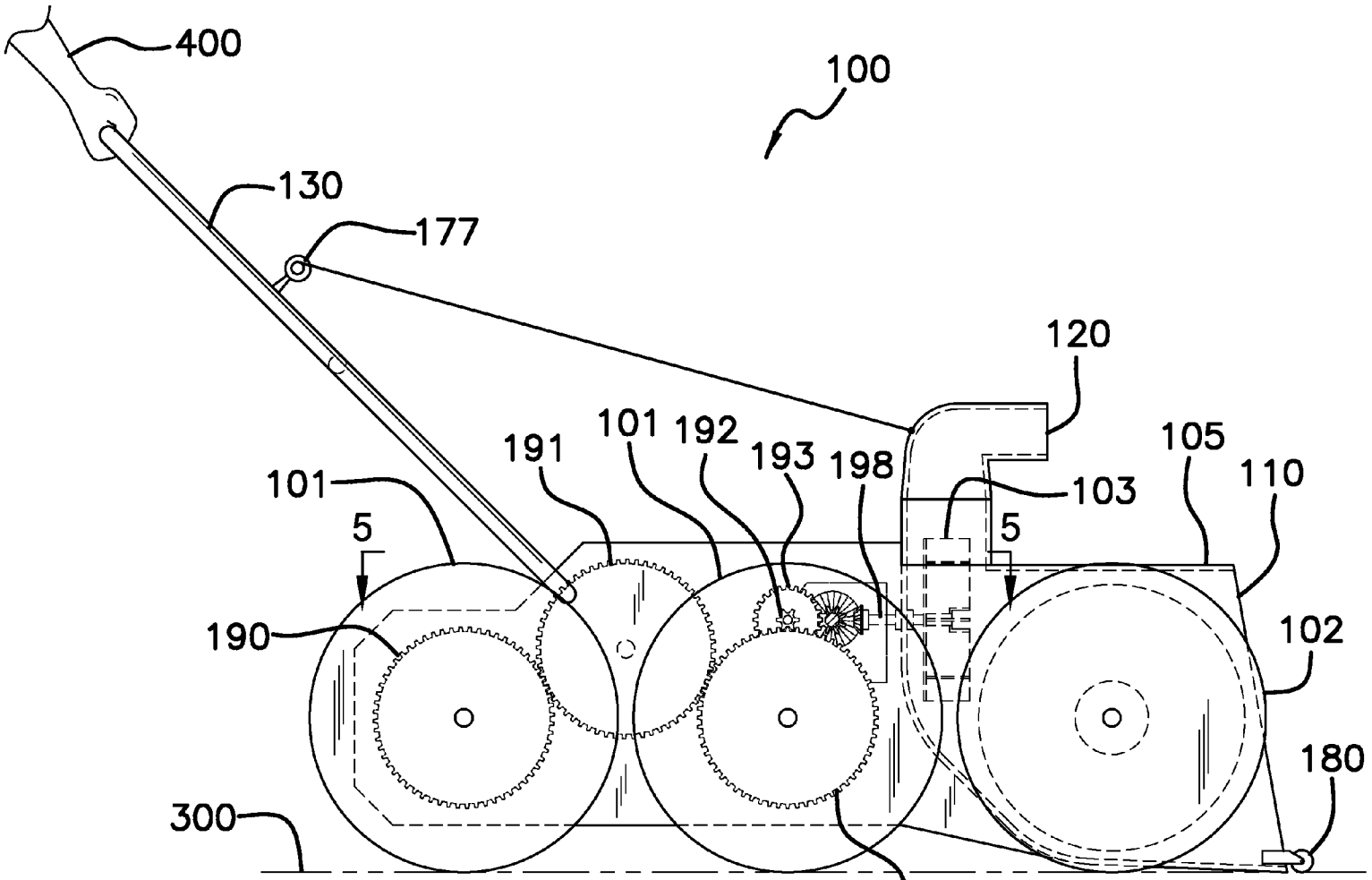
FIG. 1 is a side view of an embodiment of the disclosure.
Figure 2:
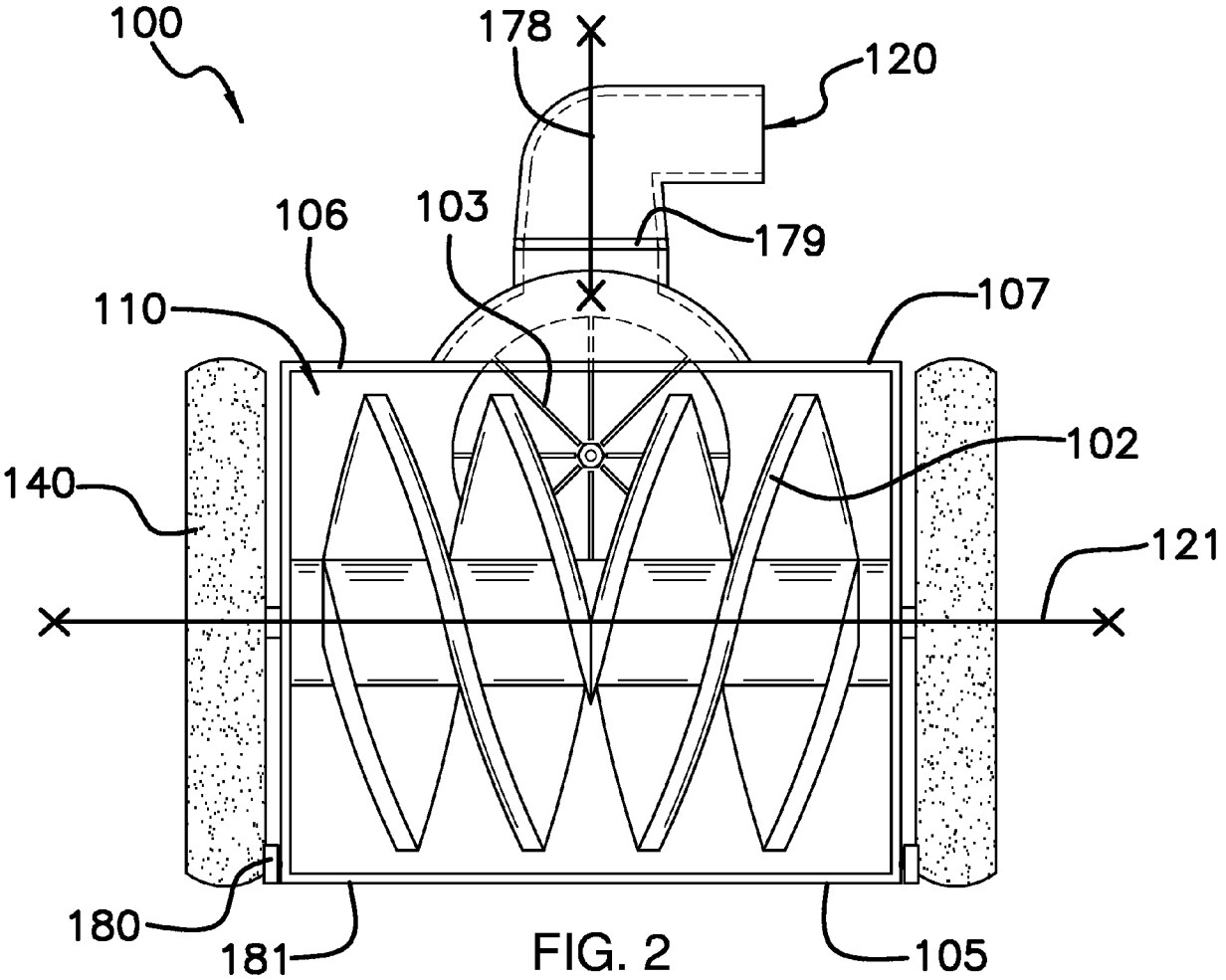
FIG. 2 is a front view of an embodiment of the disclosure.
Figure 3:
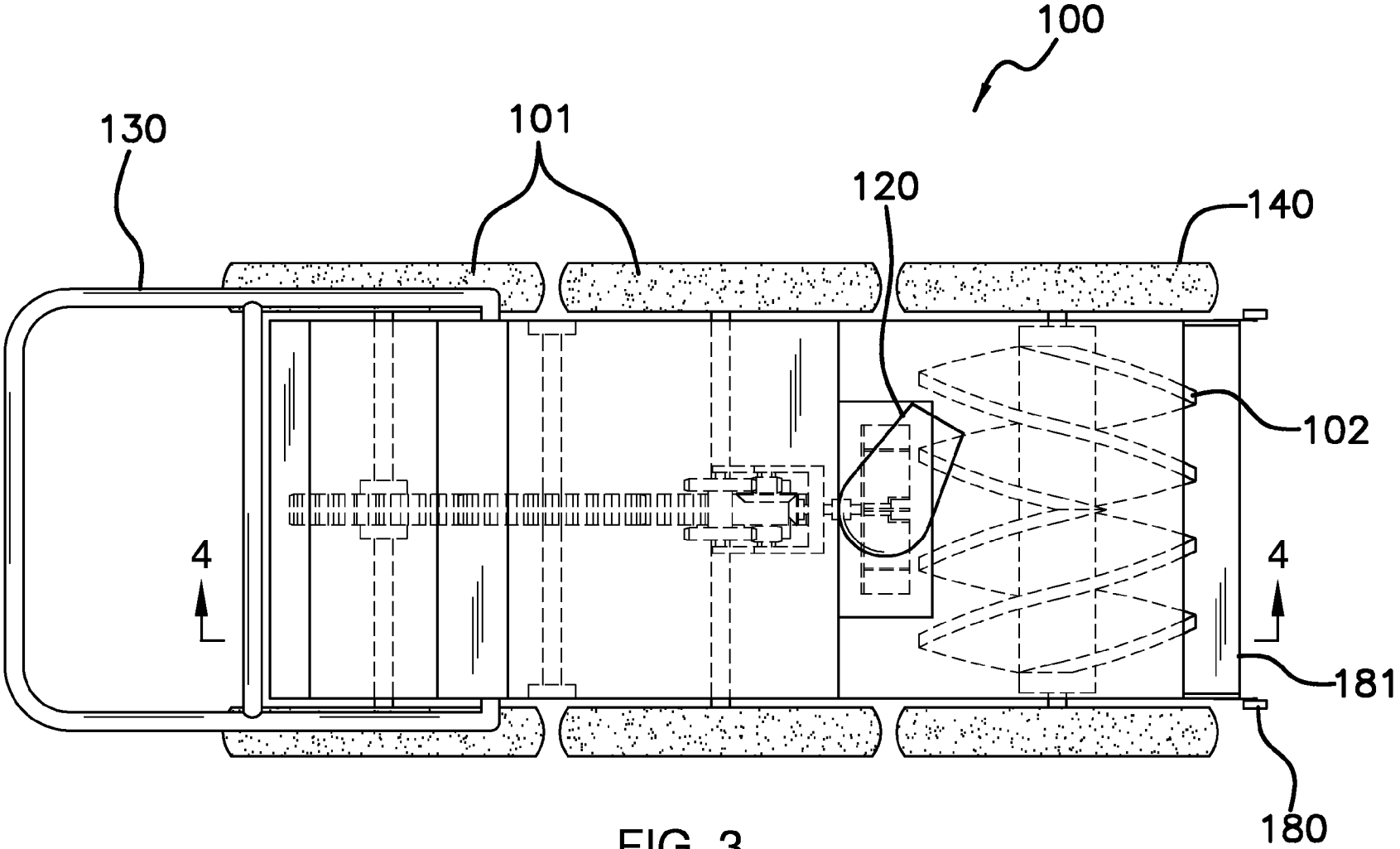
FIG. 3 is a top view of an embodiment of the disclosure.
Figure 4:
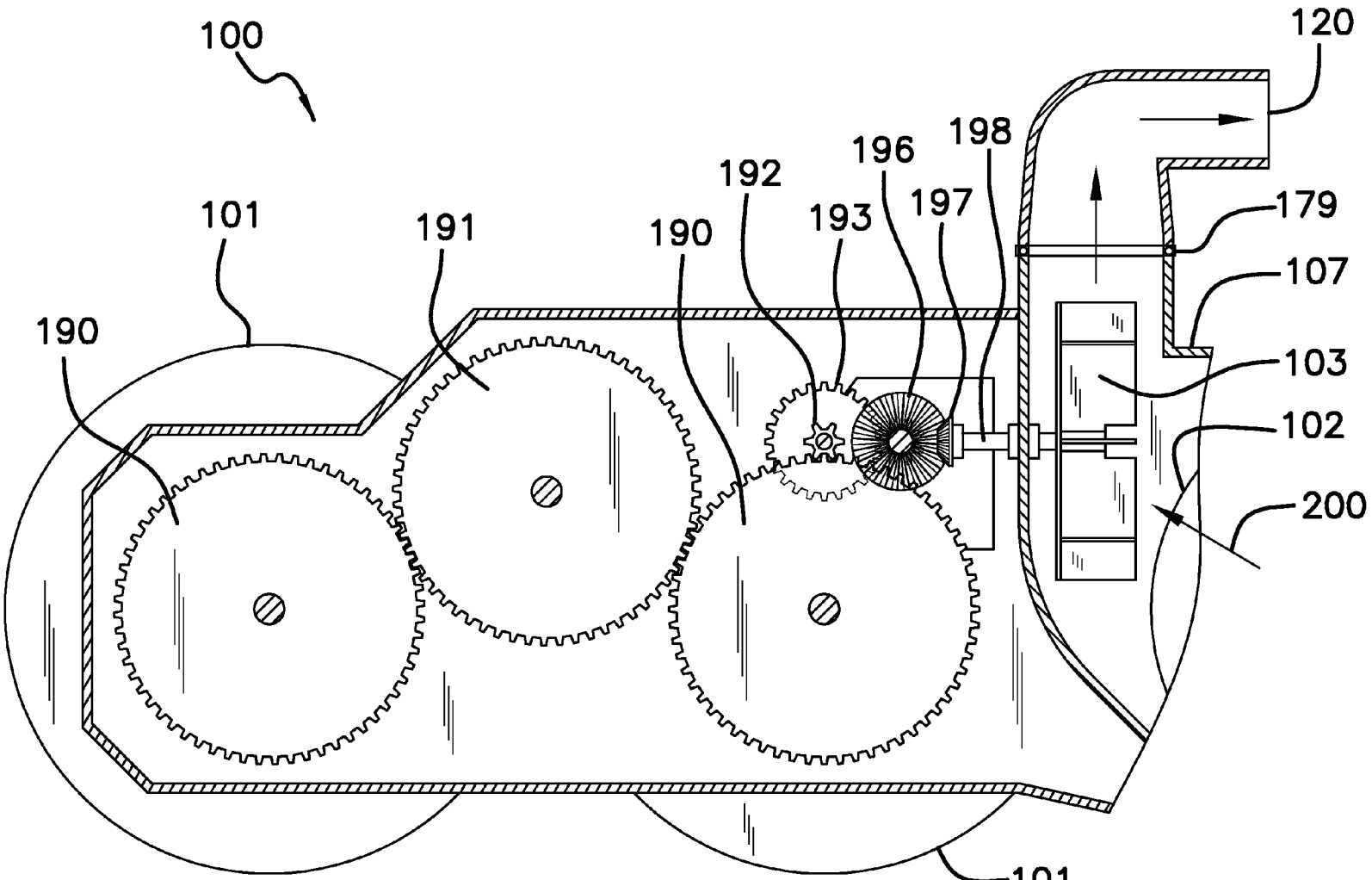
FIG. 4 is a cross-sectional view of an embodiment of the disclosure along line 4-4 in FIG. 3.
Figure 5:
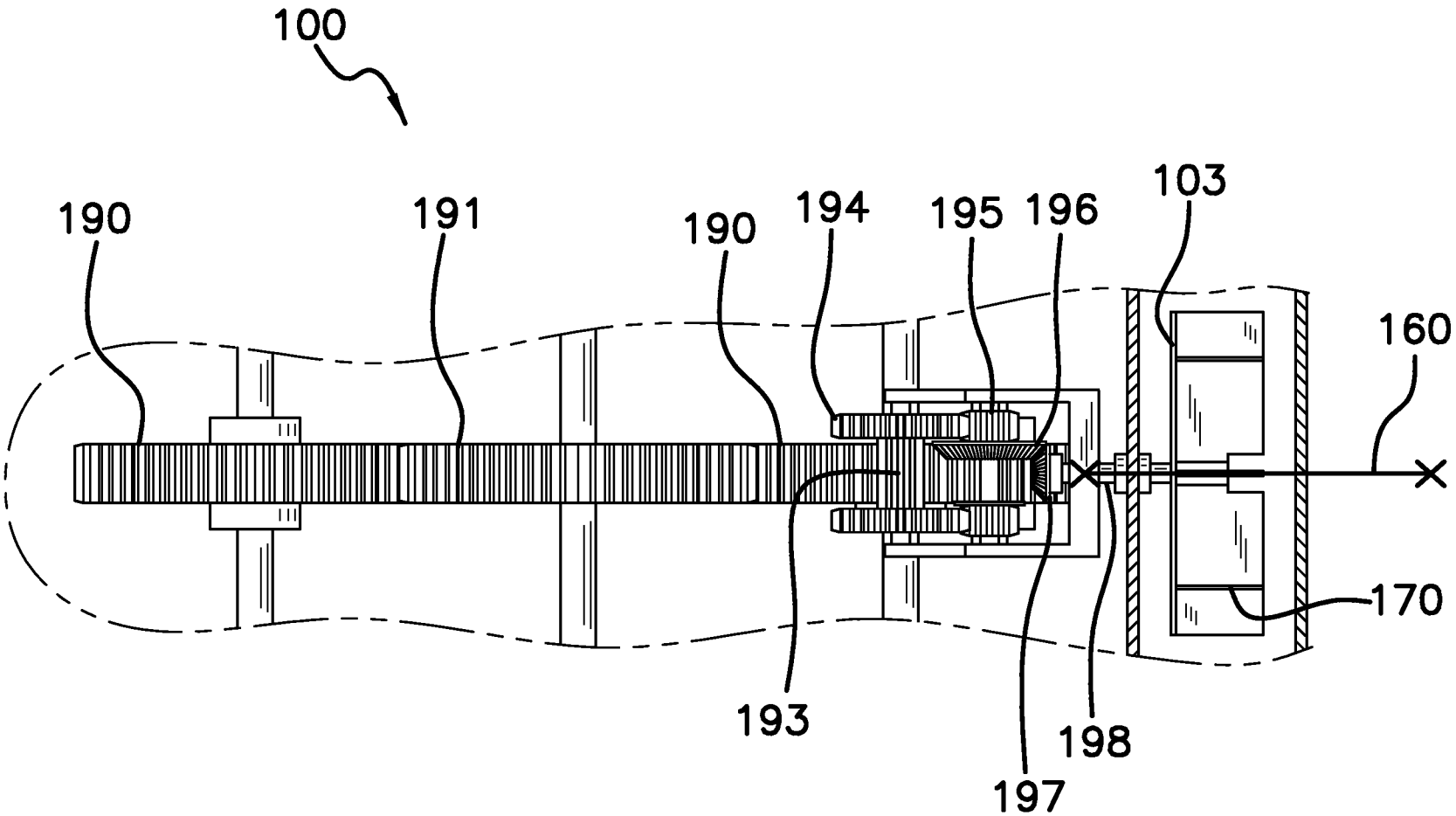
FIG. 5 is a cross-sectional view of an embodiment of the disclosure along line 5-5 in FIG. 1.

Detailed reference will now be made to a first potential embodiment of the disclosure, which is illustrated in FIGS. 1 through 5. The mechanical snow thrower 100 (hereinafter invention) relies on power delivered from wheels 101 to an auger 102 and a fan 103 to propel snow 200 from an inlet 110 to an outlet 120. Essentially, the auger 102 sweeps the snow 200 into a housing 105 and the fan 103 then lifts or otherwise propels the snow 200 out of the housing 105 through the outlet 120 the inlet 110 is located on the housing 105.

The housing 105 is adapted to provide a path for the snow 200 to travel through the portion of the invention 100 that may be referred to as the mechanical snow thrower. The housing 105 includes the inlet 110 where the snow 200 enters the invention 100 and the outlet 120 where the snow 200 exits the invention 100. The inlet 110 is generally an opening at a front surface 106 of the housing 105 that scopes the snow 200 into the invention 100, whereas the outlet 120 is generally a component that extends upwardly from a top surface 107 of the housing 105, and the outlet 120 directs snow 200 away from a clearing path formed when the invention 100 in use.

A handle 130 is attached to the housing 105. Moreover, the handle 130 is manually pushed via an operator 400 in order to propel the invention 100. The housing 105 may be made of any material but preferably a lightweight and sturdy material such as aluminum or plastic.

Within the inlet 110 of the housing 105, the auger 102 is rotatable engaged. Moreover, the auger 102 has an axis of rotation 121 that is roughly parallel to a ground 300 and perpendicular to the direction of travel of the invention 100. Connected to the auger 102, either directly or indirectly through a transmission, are at least two auger wheels 140. Typically the at least two auger wheels 140 would be positioned outside of the housing 105. The frictional force on the at least two auger wheels 140 on the ground 300 causes the at least two auger wheels 140 to rotate as the operator 400 pushes or pulls on the handle 130, thus causing the auger 102 to rotate, and generally sweeping snow 200 into the housing 105 and toward the fan 103. The transmission may be used to gain a mechanical advantage so that the auger 102 may rotate many degrees relative to the degrees of the rotation of the at least two auger wheels 140.

Also within the housing 105, the fan 103 is rotatable. A fan axis of rotation 160 is roughly parallel to the ground 300, and parallel to the direction of travel of the invention 100. The outlet 120 is located adjacent to the fan 103 so that snow 200 may be moved by the fan 103 and out of the housing 105 by passing through the outlet 120. Connected to the fan 103, preferably indirectly through a transmission, are the wheels 101. The frictional force on the wheels 101 on the ground 300 causes the wheels 101 to rotate as the operator 400 pushes on the handle 130, thus causing the fan 103 to rotate, and generally sweeping snow 200 from the auger 102 and through the outlet 120. The transmission may be used to gain a mechanical advantage so that the fan 103 may rotate many degrees relative to the degrees of the rotation of the wheels 101.

Blades 170 of the fan 103 maybe shaped to assist movement of the snow 200 out of the outlet 120. For example, the blades 170, away from the fan axis of rotation 160, may be cupped or bowl-shaped to provide a surface area on the blade 170 that can move the snow 200.

While no specific circumference of the wheels 101 is required, the larger the circumference of the wheel 101, the larger the rotational motion relative to the linear distance traveled over the ground 300. That is, large wheels mean that the operator 400 only has to travel a short distance over the ground to produce significant rotation of the auger 102 and/or fan 103. This effect can be enhanced by gear ratio utilized in the transmission.

Differing wheels and/or gear ratios may be used for the auger 102 and the fan 103. For example, the auger 102 may be set to rotated slowly compared to the fan 103. This would insure that the fan 103 is not overwhelmed by the amount of snow 200 brought through the inlet 110 by the auger 102.

Material of the wheel 101 is not particularly critical, but a dense material giving weight to the wheel 101 is preferred to improve the grip of the wheel 101 on the ground surface 300. Likewise tires and/or spikes may be used to improve grip.

In addition the wheels 101 and auger wheels 140 connected to the auger 102 and/or fan 103, inlet wheels 180 may be utilized on the 105 housing near the inlet 110 to keep a bottom edge 181 of the housing 105 from catching on small obstacles on the ground surface 300.

Furthermore, the handle 130 may include a lever 177 to adjust the direction of the outlet 120. The outlet 120 is rotatably affixed onto the top surface 107 of the housing 105, and is able to rotate about a vertical axis 178. A bearing 179 may be used to connect the outlet 120 onto the top surface 107 of the housing 105. The operator 400 may also pull on the handle 130 to reverse the motion of the auger 102 and or fan 103 to reverse the flow of snow 200. This may be useful to dislodge clogs.

Connected to the wheels 101 is a first gear 190. The first gear 190 is affixed to the wheels 101, and rotates in concert therewith. The first gears 190 are in mechanical connection with one another via a second gear 191. One of the first gears 190 is also in mechanical connection with a third gear 192. The third gear 192 is smaller than the first gears 190 as well as the second gear 191. The third gear 192 is in mechanical connection with a fourth gear 193. The fourth gear 193 is affixed to the third gear 192, and rotates in concert. The fourth gear 193 is in mechanical connection with a fifth gear 195. The fifth gear 195 is affixed to a sixth gear 196. The sixth gear 196 is in mechanical connection with a fan drive gear 197. The fan drive gear 197 is perpendicularly-oriented with respect to the sixth gear 196. The fan drive gear 197 is affixed to a fan drive shaft 198 that is in turn affixed to the fan 103.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A mechanical snow thrower comprising:

a housing that is manually propelled, and which upon propulsion shall drive a fan and an auger;

wherein the auger is adapted to collect snow;

wherein the fan is adjacent to the auger;

wherein the fan is adapted to collect snow from the auger, and propel said snow out an outlet away from said housing;

wherein the housing is further defined with an inlet that is adapted to enable snow to enter the housing;

wherein the outlet is adapted to enable the snow to exit the housing;

wherein the inlet is provided at a front surface of the housing that scoops the snow into the invention housing, whereas the outlet is generally a component that extends upwardly from a top surface of the housing, and the outlet directs snow away from a clearing path formed when in use;

wherein a handle is attached to the housing;

wherein the handle is adapted to be manually pushed via an operator in order to propel the housing;

wherein within the inlet of the housing, the auger is rotatably engaged;

wherein the auger has an axis of rotation that is roughly parallel to a ground surface, and perpendicular to the direction of travel;

wherein the auger has at least two auger wheels that are directly connected;

wherein the at least two auger wheels are positioned outside of the housing;

wherein the frictional force on the at least two auger wheels on the ground surface causes the at least two auger wheels to rotate as the operator pushes or pulls on the handle, thus causing the auger to rotate, and generally sweeping snow into the housing and toward the fan;

wherein also within the housing, the fan is rotatable;

wherein a fan axis of rotation of the fan is roughly parallel to the ground surface, and parallel to the direction of travel;

wherein the outlet is located adjacent to the fan so that snow is moved via the fan and out of the housing via the outlet;

wherein connected to the fan is a plurality of wheels;

wherein the plurality of wheels rotate on the ground surface, which causes the plurality of wheels to rotate as the operator pushes on the handle, thus causing the fan to rotate, and sweeping snow from the auger and through the outlet.

2. The mechanical snow thrower according to claim 1 wherein the fan is further defined with a plurality of blades; wherein the plurality of blades have a curvature, which is directed away from the fan axis of rotation.

3. The mechanical snow thrower according to claim 2 wherein at least one inlet wheel is included on the housing; wherein the at least one inlet wheel is adjacent to the inlet of the housing in order to keep a bottom edge of the housing from catching on small obstacles on the ground surface.

4. The mechanical snow thrower according to claim 3 wherein the handle includes a lever to adjust the direction of the outlet; wherein the outlet is rotatably affixed onto the top surface of the housing, and is able to rotate about a vertical axis.

5. The mechanical snow thrower according to claim 4 wherein a bearing is used to connect the outlet onto the top surface of the housing.

6. The mechanical snow thrower according to claim 5 wherein connected to the wheels is a first gear; wherein the first gear is affixed to the wheels, and rotates in concert therewith.

7. The mechanical snow thrower according to claim 6 wherein the first gears are in mechanical connection with one another via a second gear; wherein one of the first gears is also in mechanical connection with a third gear.

8. The mechanical snow thrower according to claim 7 wherein the third gear is smaller than the first gears as well as the second gear; wherein the third gear is in mechanical connection with a fourth gear; wherein the fourth gear is affixed to the third gear, and rotates in concert.

9. The mechanical snow thrower according to claim 8 wherein the fourth gear is in mechanical connection with a fifth gear; wherein the fifth gear is affixed to a sixth gear; wherein the sixth gear is in mechanical connection with a fan drive gear.

10. The mechanical snow thrower according to claim 9 wherein the fan drive gear is perpendicularly-oriented with respect to the sixth gear; wherein the fan drive gear is affixed to a fan drive shaft that is in turn affixed to the fan.

* * * * *